United States Patent [19]

Kuroiwa et al.

[11] Patent Number: 4,616,621

[45] Date of Patent: Oct. 14, 1986

[54] METHOD OF AIR-FUEL RATIO CONTROL OF INTERNAL COMBUSTION ENGINES OF AUTOMOBILES

[75] Inventors: Hiroshi Kuroiwa, Hitachi; Yoshishige Oyama, Katsuta, both of Japan

[73] Assignee: Hitachi, Ltd., Tokyo, Japan

[21] Appl. No.: 542,994

[22] Filed: Oct. 18, 1983

[30] Foreign Application Priority Data

Oct. 18, 1982 [JP] Japan ..... 57-181283

[51] Int. Cl.[4] ..... F02B 3/00

[52] U.S. Cl. ..... 123/585; 123/339; 123/494; 123/488

[58] Field of Search ..... 123/585, 587, 589, 440, 123/339, 489, 494, 486, 480, 488

[56] References Cited

U.S. PATENT DOCUMENTS

| | | | |
|---|---|---|---|
| 4,084,563 | 4/1978 | Hattori | 123/586 |
| 4,106,451 | 8/1978 | Hattori | 123/589 |
| 4,240,145 | 12/1980 | Yano | 123/587 |
| 4,474,153 | 10/1984 | Hanamoto | 123/587 |

*Primary Examiner*—Ronald B. Cox

*Attorney, Agent, or Firm*—Antonelli, Terry & Wands

[57] ABSTRACT

A method of air-fuel ratio control for automotive internal combustion engine in which the amount of fuel to be supplied to the internal combustion engine is determined in accordance with the amount of air passing through a main air intake path, and the amount of air in a bypass is controlled in a manner to attain a predetermined air-fuel ratio for a lean mixture gas which is determined by a predetermined operating mode of the automobile. The amount of supplied fuel which changes with the amount of air in the bypass is thus corrected to perform the lean mixture gas operation in the predetermined operating mode.

8 Claims, 8 Drawing Figures

METHOD OF AIR-FUEL RATIO CONTROL OF INTERNAL COMBUSTION ENGINES OF AUTOMOBILES

The present invention relates to a method of electronically controlling the air-fuel ratio of an internal combustion engine of motor vehicles.

The torque required of an engine of a motor vehicle is determined by the driver deciding the operating conditions of the vehicle, and the accelerator is operated on the basis of necessary torque to control the opening of the throttle valve. The relationship between the torque generated in the engine and acceleration, that is, the relationship between the torque and the opening of the throttle valve, is sensed by the driver and the driver operates the accelerator on the basis of this sensation.

In the air-fuel ratio control of an automobile engine, it is well known from, for example, Japanese Patent Laid Open Application No. 48742/83 that the combustion efficiency is improved by driving the engine with a lean mixture gas and a satisfactory combustion efficiency is obtained at an air-fuel ratio of about sixteen. It is therefore desirable to shift the air-fuel ratio to lean side in accordance with the operating mode of the engine. Specifically, when the air-fuel ratio is increased to, say, approximately twenty, the $NO_X$ content of the exhaust gas is extremely reduced and the carbon monoxide CO and hydrocarbon HC are generated in much lesser amount. To drive the engine with lean mixture gas, therefore, is advantageous in that the catalyst is not affected under a heavy load on the engine.

Additionally, there is a relationship between the unit amount of air intake and the generated torque and, in an operation with a lean mixture gas, the energy source, that is, fuel for each unit amount of air is reduced, and therefore, if the fuel consumption efficiency is greatly improved somewhat, the torque generated is reduced.

In conventional air-fuel ratio control systems, the driver operates the accelerator to control the throttle opening by forecasting the generation of torque. In the process, the driver merely controls the amount of air intake into the engine but not the amount of fuel supplied directly related to torque. The conventional control systems have not posed any great problem since the ratio of intake air amount to the fuel is approximately in a stoichiometric range, and in this range of air-fuel ratio, the engine torque generated does not change greatly with the amount of intake air.

If the conventional air-fuel ratio control systems are applied directly to the control of lean air-fuel mixture, however, the shifting from normal control (the control at about stoichiometric air-fuel ratio or control of rich mixture gas) to lean mixture gas control reduces the torque generated as compared with the amount of operation by the driver, thereby leading to an unsmooth operation in which passengers in the vehicle are subjected to some discomfort. In order to ensure a smooth drive in the motor vehicle smoothly, the relationship between the in operation of the engine or sensed by the driver and the actual torque generated must be maintained in different engine operating modes such as start, low, middle and high speed operations.

The object of the present invention resides in providing a control system for an internal combustion engine, in which the air-fuel ratio is controlled in a manner not to reduce the generated torque against the amount of driver operation of the accelerator even in lean mixture gas control mode.

According to the present invention, an air-fuel ratio control system is provided wherein the supplied fuel is determined in accordance with the amount of driver operation of the accelerator or throttle valve opening, so that the lean mixture gas is controlled by controlling the intake air amount to improve the fuel combustion efficiency, that is, the generated engine torque for unit fuel consumption. Although the fuel supplied to the engine may be controlled directly by the amount of accelerator operation, that is, the torque requirement of the driver to control the intake air amount to achieve the optimum air-fuel ratio, it is easier to indirectly determine the fuel amount. Specifically, the amount of air is more easily controlled in accordance with the throttle opening which is controlled by the accelerator so as to supply the fuel in the amount corresponding to the main air amount controlled by the throttle valve. In the lean mixture gas control mode (such as when running on a flat road at a medium speed), the relationship between the main air amount and the supplied fuel amount is maintained, while the air is supplied by opening a bypass valve of a bypass thereby controlling the air-fuel ratio for a lean mixture gas.

In the process, the amount of air passing through the main air intake path is somewhat reduced resulting in the supplied fuel amount being somewhat reduced by opening the bypass valve. This decrease in the supplied fuel amount is prevented by maintaining the fuel amount determined according to the throttle opening, that is, by adding the fuel by the reduced amount.

In this method of lean mixture gas control, a substantially proportionate relationship is maintained between the accelerator operation by the driver and the amount of fuel supplied to the engine as in the conventional systems. As a result, the torque approximate to the accelerator operation of the driver is generated, thus contributing to a superior operability with high riding quality. In spite of the fact that the increase in torque generation efficiency by the lean mixture gas control may somewhat increase the torque as compared with the amount of accelerator operation, the driver feeling is rather improved but the operability is not deteriorated by the increased torque thus generated.

The above and other objects, features and advantages of the present invention will be apparent from the following detailed description of the preferred embodiments of the present invention in connection with the accompanying drawings, in which.

Figure 1:
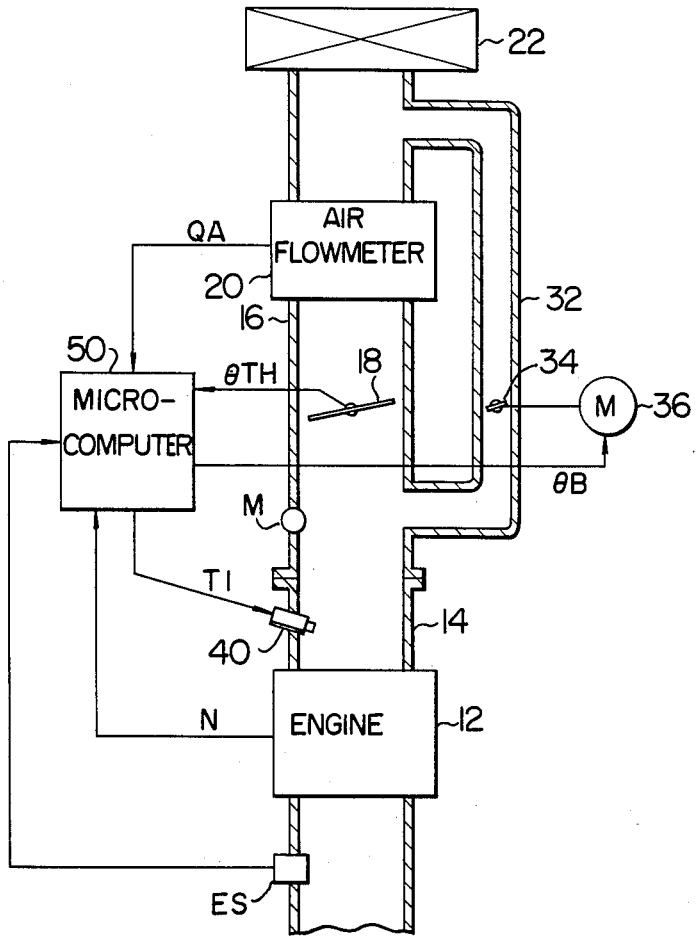
FIG. 1 is a schematic diagram showing an embodiment of the internal combustion engine of fuel injection type according to the present invention.

Referring now to the drawings wherein like reference numerals are used throughout the various views to designate like parts and, more particularly, to FIG. 1, according to this figure, an air-fuel ratio control system includes a main path 16, provided in an upstream portion of an intake pipe 14, communicating with the combustion chamber of an engine 12, with the main path 16 containing a throttle valve 18 for controlling the amount of air flowing therein. An air flowmeter 20, for metering the flow rate of the air in the main path 16, is provided further upstream. The main path 16 is provided with air from an air cleaner 22 arranged upstream thereof. In addition to the main path 16, means for supplying air includes a bypass 32 connected to the upstream of the air flowmeter 20 and the downstream of the throttle valve 18. A bypass valve 34 controls the air flowing in the bypass 32, with the bypass valve 34 being controlled by, for example, a pulse motor 36 which functions as an actuator, and a control signal $\theta$B for controlling the pulse motor is supplied from a microcomputer 50. An air amount signal QA detected by the air flowmeter 20, an engine speed N, and an opening signal $\theta$TH of the throttle valve 18 are introduced into the microcomputer 50. These signals are subjected to arithmetic operation in the microcomputer 50, so that an operation signal for the bypass valve 34 and a control signal for the fuel injection valve 40 are respectively determined and transmitted. The control signal pulse width TI for the fuel injection valve 40 and the control opening signal $\theta$B for the bypass valve 34 are determined in the following manner:

$$TI=f(QA, N, \theta B) \quad (1)$$

$$\theta B=f(\theta TH, N) \quad (2)$$

In the embodiment of FIG. 1, the pulse width TI is controlled in such a manner that the air-fuel ratio A/F is approximately 14.7 in the normal operation range. The pulse width TI is thus calculated, for example, by the following equation:

$$TI=(QA/N)(1+K1)+\Delta TI \quad (3)$$

where:

QA/N represents a basic fuel supply amount TP, and

K1 is a correction factor such as, for example, water temperature, acceleration or deceleration; and where:

$\alpha$TI is determined in accordance with the following equation:

$$\Delta TI=f(\theta B, \theta TH) \quad (4)$$

where:

ΔTI designates a correction based in the amount of air in the bypass.

Accurate air-fuel ratio control is possible by correcting the value of ΔTI though not very large. The correction ΔTI will be explained below.

Figure 2:
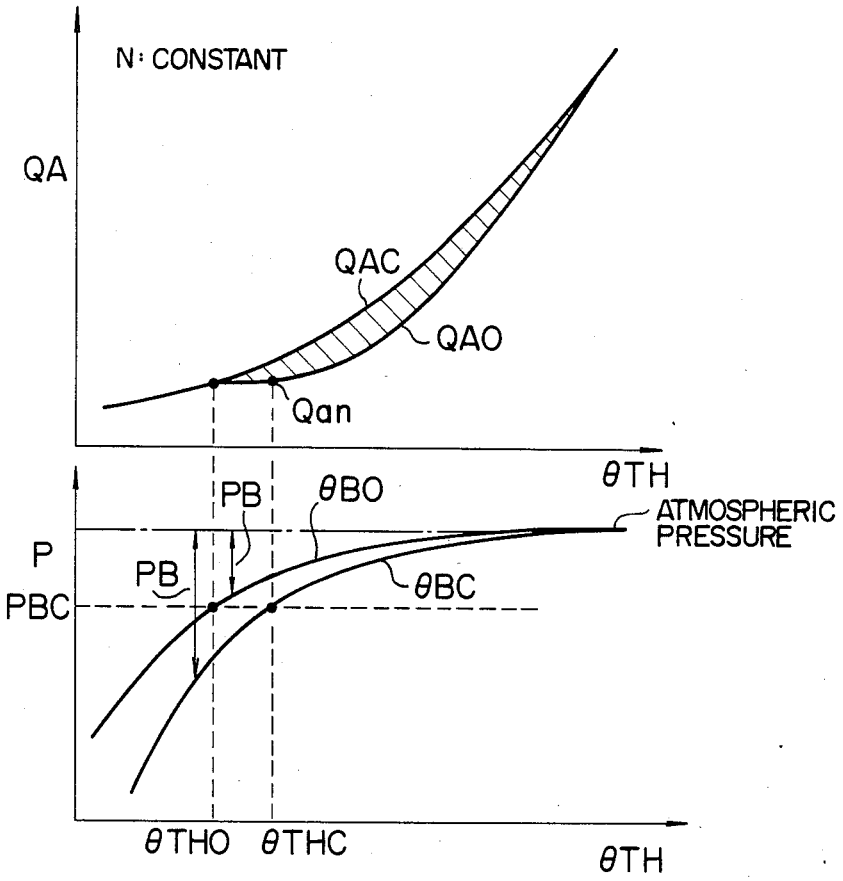
FIG. 2 is a graphical illustration of a relationship between the changes of the volume of air in the main path and the negative pressure of the intake manifold with the throttle valve opening as a parameter.

FIG. 2 provides a graphical illustration of the intake manifold pressure P and the flow rate QA in the main path 16 obtained when both the throttle valve 18 and the bypass valve 34 are changed, with the engine speed N assumed to be constant.

In the variation characteristic of intake manifold pressure obtained when the position of the throttle valve 18 is changed from closed to a fully open position, the characteristic associated with the closed bypass valve 34 and the characteristic of the fully open bypass valve 34 are respectively represented by the characters $\theta$BC and $\theta$BO. The intake manifold pressure more nearly approximates the atmospheric pressure when the bypass valve is full open than when it is closed up. When the bypass valve 34 is open to a position midway between closed and fully open position, the intake manifold pressure assumes a characteristic corresponding to the opening $\theta$B between $\theta$BO and $\theta$BC. The upstream of the throttle valve 18 is substantially at the atmospheric pressure, and the pressure between upstream and downstream of the throttle valve 18 takes a value of the difference PB with the atmospheric pressure. The higher this pressure difference PB, the higher the velocity of air flowing in the opening of the throttle valve 18, so that when the intake manifold pressure is reduced below PBC, the air flow velocity reaches that of sound. When the air flow velocity reaches the sound velocity, the air flow velocity is saturated and maintained constant regardless of the pressure difference PB. The intake manifold pressure PBC associated with such saturation will hereinafter be referred to as the critical pressure. At an intake manifold pressure lower than the critical pressure PBC, the flow velocity is determined regardless of the intake manifold pressure and therefore the flow rate QA of the main path 16 depends solely on the opening of the throttle 18.

At an intake manifold pressure higher than the critical pressure PBC, the flow rate in the main path 16 is determined by the opening of the throttle 18 and the pressure difference PB. Since the intake manifold pressure changes with the opening of the bypass valve 34 as described above, the flow rate QA of the main path 16 also varies with the opening of the bypass valve as shown by the hatched part in the graph. The flow rate of the bypass for the closed state of the bypass valve 34 is designated by QAC, while the flow rate of the main path 16 for the fully open position of the bypass valve is indicated by QAO. When the bypass valve 34 is opened midway between closed and fully open positions, the flow rate of the main path 16 assumes a characteristic between QAC and QAO in accordance with the opening involved. In accordance with the opening of the bypass valve 34, the flow rate of the main path 16 is reduced along the characteristic shown by the hatched part. As a result, if the fuel amount is determined according to the flow rate QA of the main path 16, the fact that the flow rate of the main path 16 is reduced in accordance with the opening of by bypass valve 34 reduces the fuel supply as compared with the amount of drive operation, thus reducing the torque generated. The resulting decrease in the torque as compared with the amount of driver operation necessitates the value ΔTI for compensation for torque reduction. The correction ΔTI is thus computed on the basis of equation (4) to increase the fuel amount.

Figure 3:
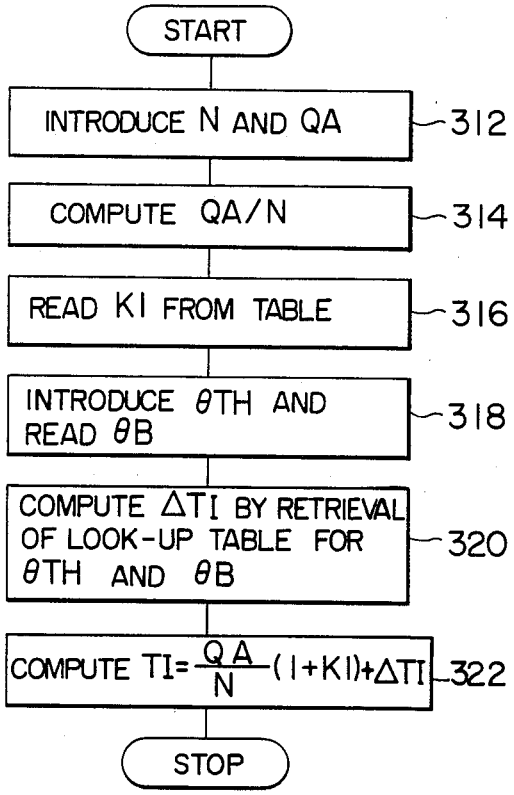
FIG. 3 is a flowchart for calculating fuel amount.

As shown in the fuel computation flowchart of FIG. 3, at step 312, the engine speed N and the air amount QA are introduced as parameters. At step 314, the basic fuel supply amount TP is computed from the engine speed N and the air amount QA, followed by step 316 for reading the correction factor K1 from the table. This correction factor K1 is determined in accordance with the water temperature, acceleration, deceleration, etc. Step 318 reads out the bypass valve opening $\theta B$ computed from equation (2) in a separate flowchart in response to the throttle opening $\theta TH$ and the engine speed N. Step 320 retrieves the correction $\Delta TI$ from the look-up table stored in memory with the throttle valve opening $\Delta TH$ and the bypass valve opening $\theta B$ as parameters. Step 322 is for computing the fuel supply from equation (3) and producing the same. The injector in FIG. 1 supplies fuel to the engine on the basis of the result of this computation. Although the correction $\Delta TI$ is determined from parameters $\theta TH$ and $\theta B$ in the embodiment under consideration, the engine speed N may be added for an improved accuracy. This is made possible by providing a read-only-memory for storing a second look-up table with the engine speed N and the result of retrieval at step 320 as parameters and retrieving the table by the detected parameters.

Figure 4:
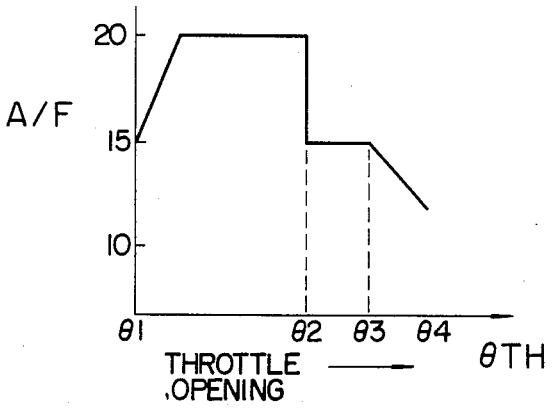
FIG. 4 is a graphical illustration of a relationship between the air-fuel ratio and the throttle valve opening as a parameter.
Figure 5:
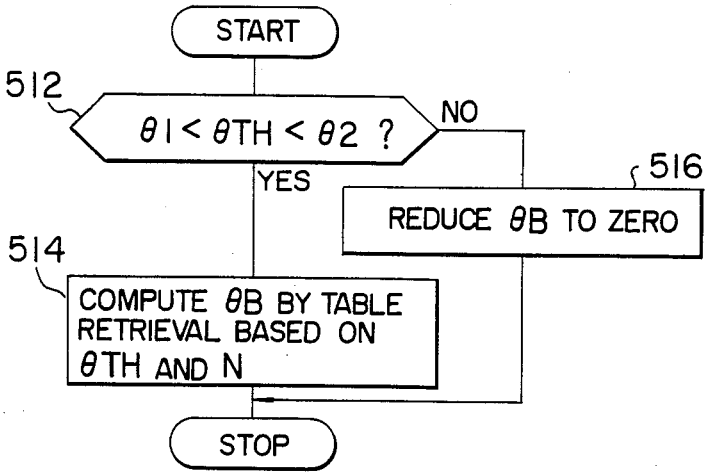
FIGS. 5 and 6 are flowcharts for calculating the bypass valve opening.

By adding air further to the mixture gas in the main path 16, a predetermined air-fuel ratio is obtained. The change of a target air-fuel ratio with the opening of the throttle valve 18 changed from closed to open state is shown in FIG. 4. In this embodiment, the lean mixture gas operation is performed in the throttle opening range from $\theta 1$ to $\theta 2$ which represents the start and operation on a flat road, while the range from $\theta 2$ to $\theta 3$ represents an operation on a gentle slope or a high speed operation. As shown in FIG. 5 in the step 12 a decision is made as to whether or not the opening of the throttle valve 18 is between $\theta 1$ and $\theta 2$, and if so, the process proceeds to step 14. At step 14, the bypass valve opening $\theta B$ is retrieved and produced from the look-up table held in the read-only-memory with the throttle valve opening $\theta TH$ and engine speed N as parameters. A pulse motor controls the bypass valve 34 and supplies air to the engine in response to the control signal $\theta B$. If the operating conditions are different and the throttle opening fails to satisfy the conditions of step 512, then the control signal $\theta B$ is produced for reducing the opening of the bypass valve 34 to zero. At the same time, the control signal $\theta B$ is stored in memory to permit the use of $\theta B$ in the flowchart of FIG. 3.

According to the embodiment under consideration, the opening of the bypass valve 34 is controlled in accordance with the opening of the throttle valve 34 resulting from driver operation. As a result, the lean mixture gas control conforming to the feeling of the driver is performed, thus facilitating the driving operation.

Figure 6:
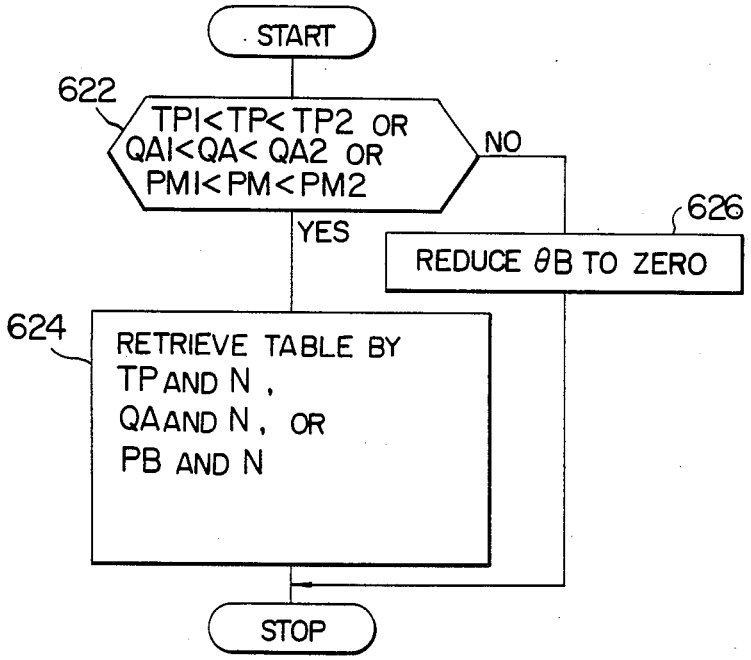

In FIG. 6, instead of the throttle valve opening $\theta TH$ used at step 512 of FIG. 5, the basic fuel amount TP, the air amount QA in the main path 16 or the negative pressure PM of the intake manifold may be used. The basic fuel amount is determined by the equation below from the air amount QA and the engine speed N.

$$TP=(QA/N) \tag{5}$$

As an alternative, the equation (6) below may be used taking the correction of K1 in equation (3) into consideration.

$$TP=(QA/N)\,(1+K1) \tag{6}$$

When QA is used as a parameter, it is detected as an output of the air flowmeter. The negative pressure PM, if used as a parameter, may be detected by a negative pressure sensor mounted in the downstream of the throttle 18 such as at a point M in FIG. 1. In accordance with these parameters TP, QA and PM, a decision is made as to whether or not the lean mixture gas control range is involved in the same manner as at step 512, and if the lean mixture gas control range is involved, the process is passed to step 624. If the lean mixture gas control range is not involved, the process proceeds to step 626 to reduce the bypass valve opening $\theta B$ to zero. Step 624 retrieves as an input a required parameter from the look-up table on the basis of parameters TP and N, QA and N, or PB and N, and produces the bypass valve opening $\theta B$ as an output. This bypass valve opening $\theta B$ is stored for use in the flowchart of FIG. 3 and is produced for controlling the pulse motor 36 on the other hand.

In this embodiment, the lean mixture gas control operation is possible in accordance with the parameters TP, QA and PM providing the actual load data of the engine, thereby permitting a reasonable control in response to the engine operation. Further, a system may be provided without a throttle opening sensor, in which case the control shown in FIG. 6 is naturally employed with a lower system cost by the elimination of the throttle opening sensor.

Figure 7:
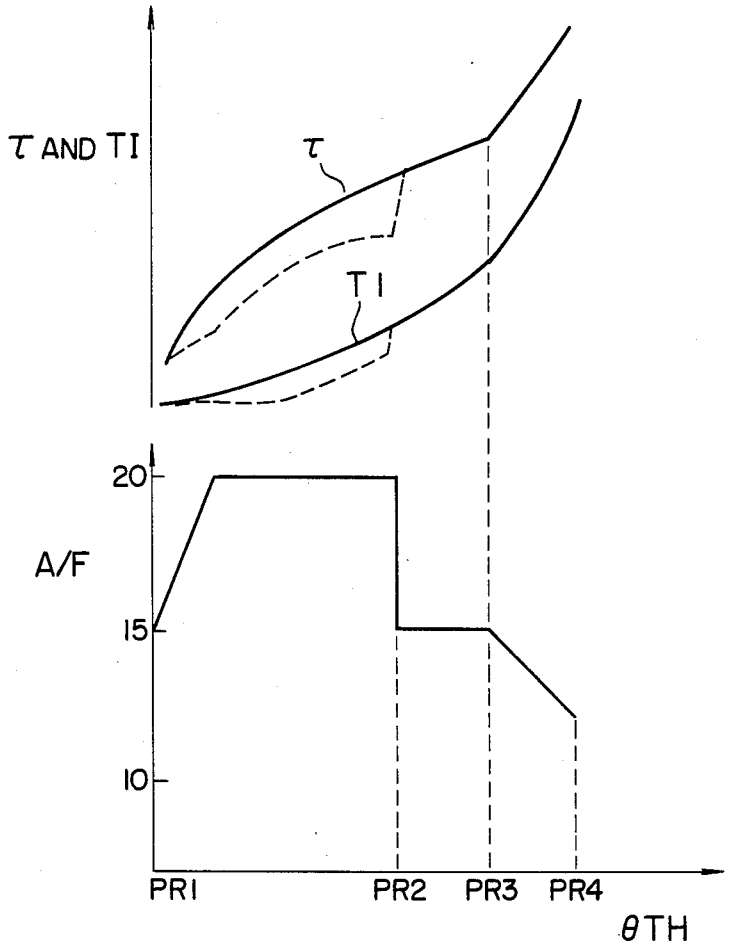
FIG. 7 is a graphical illustration of a relationship between the torque generated and the fuel supplied with the throttle valve opening as a parameter.

In the first and second embodiments described above, the throttle valve opening $\theta TH$, the basic fuel supply amount TP, the air intake QA of the main path or the intake manifold negative pressure PM is used as a parameter PR to produce a smooth engine torque characteristic $\tau$ in accordance with the fuel supply TI as shown by the solid line in FIG. 7. The dotted curve in FIG. 7 represents a torque change obtained when the present invention is not applied. By the way, the abscissa in FIG. 7 may indicate not $\theta TH$ but another load data such as $\theta A$, TP or PM, Further, the lean mixture gas operation range is selected as desired on the basis of the engine characteristics, thus achieving superior control characteristics.

Figure 8:
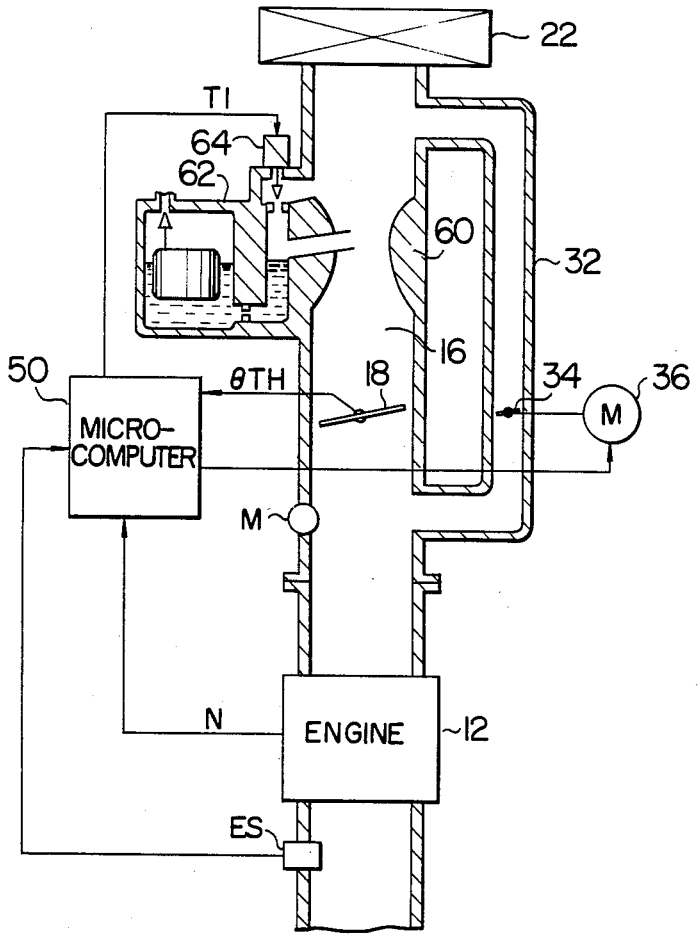
FIG. 8 is a schematic view of a internal combustion engine according to another embodiment of the present invention.

If the air-fuel ratio is to be controlled more accurately, an exhaust sensor ES such as an $O_2$ sensor or a lean gas sensor is provided in the exhaust gas, and the output signal of the sensor ES is used to control the bypass valve 34 and/or the fuel injection valve 40 by feedback as shown in FIGS. 1 and 8.

In FIG. 8 a carburetor rather than the injector 40 is employed; however, the control of this embodiment is essentially identical with that of the system of FIG. 1. In the system of FIG. 8 a carburetor 62 is used in place of the air flowmeter 20 and the injector 40. The carburetor 62 is provided with a solenoid valve 64, and according to the opening of the solenoid valve 64, the characteristic of the fuel supplied to the main path 16 is controlled. Also, in the case where two solenoid valves are employed for the low-speed and main systems, a control signal TI is supplied to the solenoid valves of these two systems.

As in the first and second embodiments using an injector 40, the air-fuel ratio is controlled to about 14.7 against the air amount of the main path 16 for the throttle valve opening between $\theta 1$ and $\theta 2$, so that the solenoid valve 64 is also supplied with a control signal associated with the air-fuel ratio of about 14.7. As explained with reference to the first embodiment, the opening of the bypass valve 34 may be computed by the flowchart of FIG. 5. With an increase of the opening of the bypass valve 34, the amount of air in the main path 16 decreases as explained with reference to the hatched portion in FIG. 2, thus reducing the fuel supply amount. In order to prevent this inconvenience, it is necessary to increase the fuel in accordance with the opening $\theta B$ of the bypass valve 34 by the control signal applied to the solenoid valve 62. The range of correction by increased fuel amount is the one associated with the air flow velocity in the throttle valve lower than velocity of sound as in the case using the injector 40.

Although the embodiment of FIG. 8 uses the throttle valve opening as a parameter and the flowchart of FIG. 5 for determining the bypass valve opening, the manifold pressure PM may be used as an additional parameter.

In the embodiment of FIG. 8, the supplied fuel changes with the negative pressure of the venturi 60, resulting in a higher response under transient operating conditions. Further, since the fuel is supplied in accordance with the amount of driver operation as in the above-mentioned embodiments, the torque corresponding to the amount of driver operation is generated. Furthermore, the fact that the lean mixture gas operation is possible permits the consumed fuel to be converted into torque at high efficiency.

We claim:

1. A method of air-fuel ratio control for an internal combustion engine of an automobile, in which the fuel amount to be supplied to the internal combustion engine is determined by detecting only the air amount passing through a main air intake path having a throttle valve therein, controlling the air amount passing through a bypass formed in addition to the main air intake path, said bypass having an inlet coupled to said main air intake path at a location thereof upstream of the location whereat the air amount passing through said main air intake path is detected and an outlet coupled to said main air intake path at a location thereof downstream of the location of said throttle valve, so as to attain a predetermined air-fuel ratio for a lean gas mixture determined for a predetermined operating range of the automobile, thereby performing the lean mixture gas operation in said predetermined operating range, determining the fuel amount in accordance with the output from a sensor provided at said main intake path for detecting only the amount of air passing through the main air intake path, calculating the opening of said bypass suitable for obtaining said predetermined air-fuel ratio and controlling said opening of the bypass in accordance with said calculated bypass opening.

2. A method of air-fuel ratio control for an internal combustion engine of an automobile, in which the fuel amount to be supplied to the internal combustion engine is determined against the air amount passing through a main air intake path, controlling the air amount passing through a bypass formed in addition to the main intake path to attain a predetermined air-fuel ratio for a lean gas mixture determined for a predetermined operating range of the automobile, thereby performing the lean mixture gas operation in said predetermined operating range, correcting the fuel supply amount in accordance with the air amount passing through the bypass, and increasing the fuel supply amount by $\Delta TI$, which fuel supply is reduced with a decrease of the amount of the main air intake path caused by the increase of the air amount in the bypass.

3. A method of air-fuel ratio control for an internal combustion engine of an automobile, in which the fuel amount to be supplied to the internal engine is determined against the air amount passing through a main air intake path, controlling the air amount passing through a bypass formed in addition to the main air intake path to attain a predetermined air-fuel ratio for a lean gas mixture determined for a predetermined operating range of the automobile, thereby performing the lean mixture gas operation in said predetermined operating range, correcting the fuel supply amount in accordance with the air amount passing through the bypass, and wherein a valve opening of the bypass is obtained by introducing a throttle valve opening of the main intake path and the speed of the internal combustion engine, and reading the bypass valve opening from a look-up table held in a memory with the throttle valve opening and the engine speed as parameters.

4. A method of air-fuel ratio control according to claim 2, wherein $\alpha TI$ is obtained by retriving from a look-up table held in memory with a throttle valve opening of the main intake path and a bypass valve opening of the bypass as parameters.

5. A method of air-fuel ratio control according to claim 1, wherein said internal combustion engine is of fuel injection type.

6. A method of air-fuel ratio control according to claim 1, wherein said internal combustion engine is of a type using a carburetor.

7. A method of air-fuel ratio control according to claim 2, wherein said internal combustion engine is of fuel injection type.

8. A method of air-fuel ratio control according to claim 2, wherein said internal combustion engine is of a type using a carburetor.

* * * * *